United States Patent [19]

Ochiai et al.

[11] 4,385,866

[45] May 31, 1983

[54] CURVED BLADE ROTOR FOR A TURBO SUPERCHARGER

[75] Inventors: Toshihiko Ochiai, Yokosuka; Kiyoshi Nakamura, Yokohama; Katsutoshi Nishida, Yokohama; Masato Sakai, Yokohama, all of Japan

[73] Assignee: Tokyo Shibaura Denki Kabushiki Kaisha, Kanagawa, Japan

[21] Appl. No.: 131,278

[22] Filed: Mar. 17, 1980

[30] Foreign Application Priority Data

Aug. 2, 1979 [JP] Japan ..... 54/98094

[51] Int. Cl.[3] ..... F01D 5/28

[52] U.S. Cl. ..... 416/241 B; 416/185

[58] Field of Search ..... 416/185, 241 B, 224

[56] References Cited

U.S. PATENT DOCUMENTS

| | | | |
|---|---|---|---|
| 3,834,833 | 9/1974 | Faber et al. | 416/224 |
| 3,905,723 | 9/1975 | Torti, Jr. | 416/213 R |
| 3,988,866 | 11/1976 | Booher, Jr. | 416/241 B |
| 3,998,646 | 12/1976 | Weaver . | |
| 4,123,199 | 10/1978 | Shimizu et al. | 416/241 B |
| 4,125,344 | 11/1978 | Tiefenbacher | 416/241 B |
| 4,214,906 | 7/1980 | Langer et al. | 416/241 B |

FOREIGN PATENT DOCUMENTS

| | | | |
|---|---|---|---|
| 2728823 | 1/1979 | Fed. Rep. of Germany . | |
| 2831547 | 2/1979 | Fed. Rep. of Germany | 416/241 B |
| 1496620 | 12/1977 | United Kingdom . | |
| 1500108 | 2/1978 | United Kingdom . | |
| 1521693 | 8/1978 | United Kingdom . | |

OTHER PUBLICATIONS

A. F. McLean, "Ceramics in Small Vehicular Gas Turbines" in Ceramics for High-Performance Applications, J. J. Burke, A. E. Gorum, R. N. Katz, (Eds), Brook Hill Publishing Co., (1974), p. 12.

D. J. Godfrey, "The Performance of Cermics in the Diesel Engine" in Ceramics for High-Performance Applications-II, Brook Hill Publishing Co., (1978), pp. 888-891.

"Cemented Carbide Drawing Dyes" by Schwargkepf and Kieffer from *Cemented Carbides*, pp. 242 to 250, (1960).

*Primary Examiner*—Leonard E. Smith

*Attorney, Agent, or Firm*—Oblon, Fisher, Spivak, McClelland & Maier

[57] ABSTRACT

A curved blade rotor for a radial inflow turbo supercharger which is made of ceramic material and having a plurality of curved blades each with a curved outer edge. The surface roughness of the curved outer edge is 0.8S to 2S wherein "S" indicates surface roughness according to Japanese Industrial Standard B 0601.

9 Claims, 4 Drawing Figures

CURVED BLADE ROTOR FOR A TURBO SUPERCHARGER

BACKGROUND OF THE INVENTION

1. Field of the Invention

This invention relates to a curved blade rotor for a turbo supercharger having a radial flow turbine.

2. Description of the Prior Art

A curved blade rotor made of ceramic material is shown at pages 888–891 of "CERAMICS FOR HIGH PERFORMANCE APPLICATIONS-II" published in 1978 by Brook Hill Publishing Company. The above-mentioned curved blade rotor was made by AME Ltd. in reaction bonded silicon nitride. The main object of making ceramic curved blade rotor is to replace expensive nickel alloys by cheaper, non-strategic materials and to operate the turbine at high temperatures. However, it has been found to be necessary to improve the design of the rotor in making a curved blade rotor of ceramic material.

SUMMARY OF THE INVENTION

Accordingly, an object of this invention is to provide a curved blade rotor formed of ceramic material having a desirably designed curved outer edge.

These and other objects have now been attained in the present invention by providing a curved blade rotor made of ceramic material having a plurality of curved blades each including a curved outer edge with the surface roughness of the curved outer edge being 0.8S to 2S.

BRIEF DESCRIPTION OF THE DRAWINGS

Various objects, features and attendant advantages of the present invention will be more fully appreciated as the same becomes better understood by the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
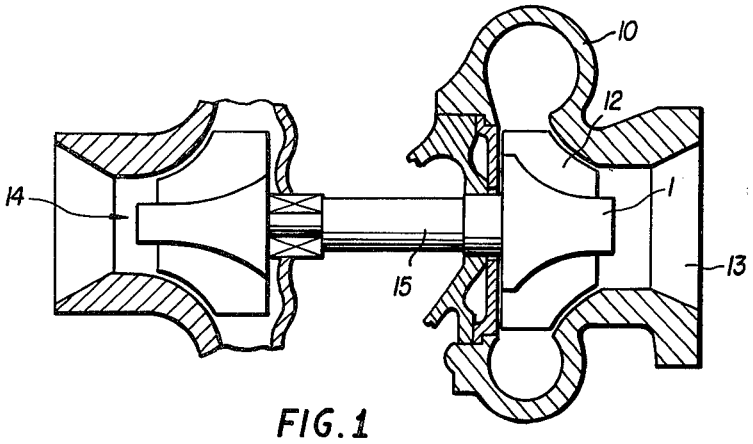
FIG. 1 is a schematic sectional view of a turbo supercharger.

As seen in FIG. 1, a turbo supercharger includes a casing 10 and a turbine rotor 11 which has a plurality of blades 12. The rotor is of the radial inward flow type and the casing defines an axially extending outlet 13. The rotor and a compressor rotor 14 are connected with each other by way of a shaft 14.

Figure 2:
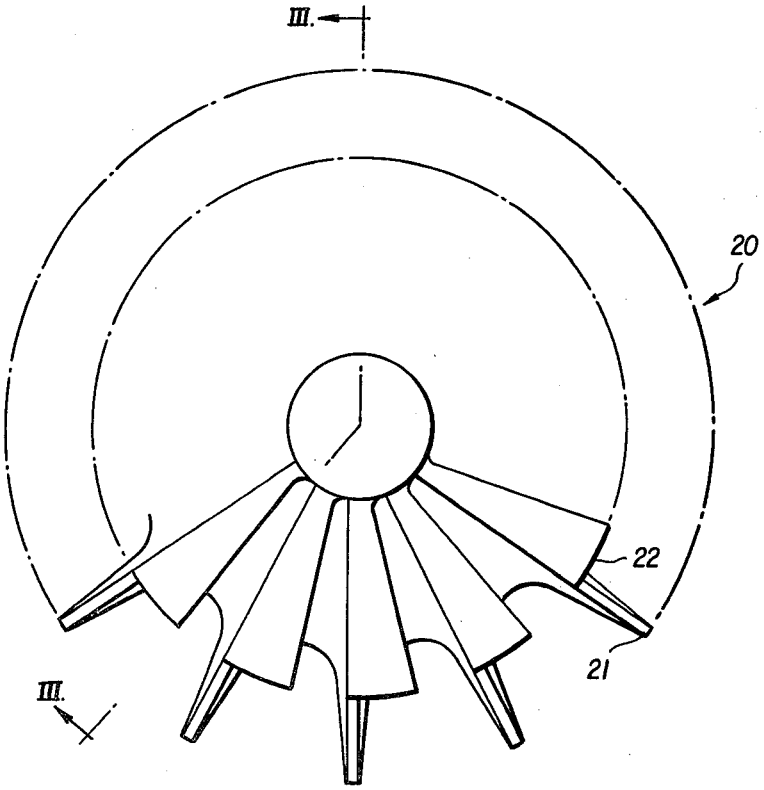
FIG. 2 is a top plan view, partly schematic, of a curved blade rotor according to the present invention.
Figure 3:
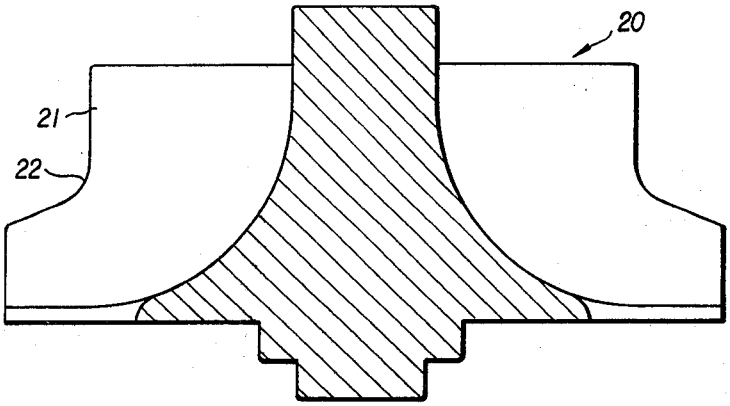
FIG. 3 is a sectional view taken substantially along the lines III—III of FIG. 2.
Figure 4:
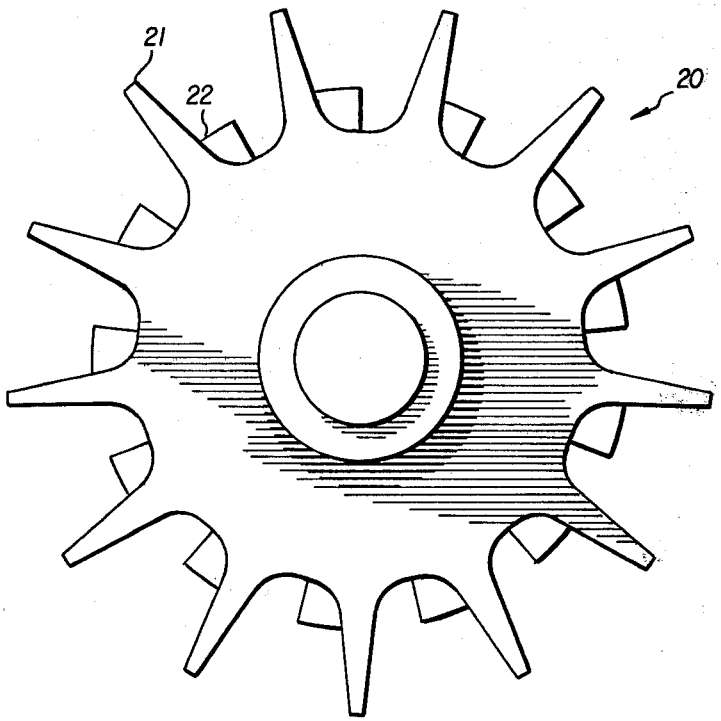
FIG. 4 is a bottom view of a curved blade rotor according to the present invention.

A curved blade rotor 20 according to this invention is shown in FIGS. 2, 3 and 4. The rotor 20 has a plurality of curved blades 21. The curved outer edge 22 of each of the curved blades 21, which borders with the casing, is surface finished. The surface roughness of the curved outer edge is 0.8S to 2S wherein the dimension "S" is used to indicate surface roughness according to the Japanese Industrial Standard B 0601 in which "S" (m)=RMS (American standard surface finish measurement) (m)×4/1.1.

Where the surface roughness of the curved outer edge exceeds 2S, high temperature and high pressure gas will drop around the curved outer edge. Therefore, the efficiency will become correspondingly low.

Where the surface roughness of the curved outer edge is less than 0.8S, the cost and time of surface finishing will become relatively high and long, respectively, and it will be difficult to produce the curved blade rotors in large scale production. Other parts, i.e. other than the curved outer edge, of the rotor are sintered because, in general, it is not necessary to surface finish such parts.

The curved blade rotor according to the present invention is used with such application as required for great resistance to heat stress. Therefore, preferably, the curved blade rotor is formed of such materials as silicon nitride, aluminum nitride, silicon oxynitride ($Si_2ON_2$), silicon aluminum oxynitride (SiAlON), silicon carbide, and silicon nitride silicon carbide ($Si_3N_4-SiC$).

The curved blade rotor according to this invention moreover has a relatively complicated shape. Therefore, preferably, the curved blade rotor is formed by furnace sintering or reaction bonding.

Where the curved blade rotor is formed by reaction bonding, it is necessary to produce spaces for gas passages in the molded mass until reaction completion. Therefore, the reaction bonded body drops in density and is of relatively low mechanical strength. Consequently, more preferably, the curved blade rotor is formed by furnace sintering. Where the curved blade rotor is formed by furnace sintering, it is easy to obtain high density and relatively high mechanical strength.

EXAMPLE

A powder mixture consisting of 84% by weight of silicon nitride, 6% by weight of yttrium oxide and 10% by weight of aluminum oxide, the mean particle size thereof being 1.1,1.2 and 0.5 microns respectively, was prepared with 2% weight of polyvinylalcohol added as a binder. The curved blade rotor shape molding was prepared by injection molding the mixture. The molding was embedded in a packing of silicon nitride powder, in a carbon vessel and put into a sintering furnace. Sintering was thus performed at 1800° C. for 5 hours in an atmosphere of nitrogen gas. The curved outer edge of the sintered product was surface finished by grinding with a diamond grindstone to obtain surface roughness of approximately 1.5S.

The specific gravity and the liner thermal expansion coefficient of the ceramic materials obtained were 3.20 g/cc and $3.1\times10^{-6}$/°C. respectively. The flexural strengths were 75 kg/mm$^2$ at room temperature, 75 kg/mm$^2$ at 700° C. and 71 kg/mm$^2$ at 1000° C.

The curved blade rotor obtained was tested in a turbo charger and the high pressure gas was found to not drop around the curved outer edges.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A curved blade rotor for a radial inflow turbo supercharger having a casing including a curved portion, said rotor comprising:

a ceramic material having a plurality of curved blades extending therefrom, each of which have a curved outer edge bordering with, and closely corresponding to, said curved portion of said casing, only said curved outer edge being machine finished to a surface roughness of 0.8S to 2S wherein "S" indicates surface roughness according to Japanese Industrial Standard B 0601, the remainder of the surface of said rotor not being machine finished.

2. A curved blade rotor according to claim 1, said ceramic material being formed by furnace sintering.

3. A curved blade rotor according to claims 1 or 2, wherein said ceramic material comprises silicon nitride.

4. A curved blade rotor according to claims 1 or 2, wherein said ceramic material comprises aluminum nitride.

5. A curved blade rotor according to claims 1 or 2, wherein said ceramic material comprises silicon carbide.

6. A curved blade rotor according to claims 1 or 2, wherein said ceramic material comprises silicon oxynitride.

7. A curved blade rotor according to claims 1 or 2, wherein said ceramic material comprises silicon aluminum oxynitride.

8. A curved blade rotor according to claims 1 or 2, wherein said ceramic material comprises silicon nitride silicon carbide.

9. A curved blade rotor according to claim 1, wherein the surface roughness is formed by grinding.

* * * * *